US006961036B2

(12) United States Patent
Chen et al.

(10) Patent No.: US 6,961,036 B2
(45) Date of Patent: Nov. 1, 2005

(54) SINGLE POLAR DRIVING METHOD FOR CHOLESTERIC LIQUID CRYSTAL DISPLAYS

(75) Inventors: Chien-Pin Chen, Tainan (TW); Sheng-Ren Chiu, Tainan (TW); Chia-Cheng Lai, Tainan (TW); Yen-Chen Chen, Tainan (TW)

(73) Assignee: Himax Technologies, Inc., Tainan (TW)

( * ) Notice: Subject to any disclaimer, the term of this patent is extended or adjusted under 35 U.S.C. 154(b) by 389 days.

(21) Appl. No.: 10/354,550

(22) Filed: Jan. 29, 2003

(65) Prior Publication Data

US 2004/0145550 A1 Jul. 29, 2004

(51) Int. Cl.[7] ..... G09G 3/36

(52) U.S. Cl. ..... 345/87; 345/94; 345/95; 345/96; 345/97

(58) Field of Search ..... 345/87, 94–97

(56) References Cited

U.S. PATENT DOCUMENTS 5,933,203 A * 8/1999 Wu et al. ..... 349/35
6,268,840 B1 * 7/2001 Huang ..... 345/94
6,717,561 B1 * 4/2004 Pfeiffer et al. ..... 345/87

* cited by examiner

*Primary Examiner*—Dennis-Doon Chow
(74) *Attorney, Agent, or Firm*—Ladas & Parry LLP

(57) ABSTRACT

A single polar driving method for a cholesteric liquid crystal display. The method comprises the steps of selecting the pixels by applying a first signal switching between a ground and a first level to the common line of the selected pixels, driving the selected pixels into a reflecting state by applying a second signal out of phase with the first signal and that switches between a second and third levels to the segment lines thereof, driving the selected pixels into a transparent state by applying a third signal in phase with the first signal and that switches between the second and third levels to the segment lines thereof, and deselecting the pixels by applying a fourth signal fixed at a fourth level to the common lines thereof.

11 Claims, 13 Drawing Sheets

| | Data | FR | output |
|---|---|---|---|
| Segment Driver | L | L | $V_{SH}$ |
| | H | L | $V_{SL}$ |
| | L | H | $V_{SL}$ |
| | H | H | $V_{SH}$ |

FIG. 6A

| | Data | FR | output |
|---|---|---|---|
| Common Driver | L | L | $V_{CM}$ |
| | H | L | $V_{CH}$ |
| | L | H | $V_{CM}$ |
| | H | H | $V_{CL}$ |

FIG. 6B

SINGLE POLAR DRIVING METHOD FOR CHOLESTERIC LIQUID CRYSTAL DISPLAYS

BACKGROUND OF THE INVENTION

1. Field of the Invention

The present invention relates to a liquid crystal display and particularly to a fast multistable liquid crystal display using a cholesteric liquid crystal material.

2. Description of the Prior Art

Recent concerted efforts in the field of liquid crystal materials have yielded a new class of reflective, cholesteric texture materials and devices. These liquid crystal materials have a periodic modulated optical structure that reflects light. The liquid crystal material comprises a nematic liquid crystal having positive dielectric anisotropy and chiral dopants. These materials are known as polymer stabilized cholesteric texture (PSCT) and polymer free cholesteric texture (PFCT).

LCDs using the reflective cholesteric texture liquid crystal are known as fast multistable LCDs (FMLCD). The reflective cholesteric texture liquid crystal (both PSCT and PFCT) has two stable states at a zero applied field. One such state is the planar texture state which reflects light at a preselected wavelength determined by the pitch of the cholesteric liquid crystal material itself. The other state is the focal conic texture state substantially optically transparent. By stable, it is meant that once set to one state or the other, the material will remain in that state, without the further application of an electric field. Conversely, for other types of conventional LCDs, each liquid crystal picture element must be addressed many times each second in order to maintain the information stored thereon. Accordingly, PSCT and PFCT materials are highly desirable for low energy consumption applications, since once set they remain so.

The configuration of FMLCDs is substantially the same as in conventional passive LCDs: picture elements (pixels) are addressed by crossing lines of transparent conducting lines known as common and segment lines respectively formed on two substrates with the cholesteric liquid crystal sealed therebetween. Conventional methods for addressing or driving such displays can be understood from FIG. 1. FIG. 1 illustrates a table showing the state of the liquid crystal material after the application of various driving voltages thereto. The liquid crystal material begins in a first state, either the reflecting state or the transparent state, and is driven with an AC voltage, having an amplitude above $V_4$ in FIG. 1. When the voltage is removed quickly, the liquid crystal material switches to the reflecting state and remains there. If driven with an AC voltage between $V_2$ and $V_3$ the material will switch into the transparent state and remain until the application of a second driving voltage. If no voltage is applied, or the voltage is well below $V_1$, then the material will not change state, regardless of the initial state.

The conventional single polar driving method of FMLCDs is described in the following accompanied by FIGS. 2A–2D. In the single polar driving method, it should be noted that all the voltage levels applied to the segment and common lines have the same polarity (positive, for example) based on the ground voltage (0V, for example), and the waveforms of the differential voltage signal between the common and segment line in each pixel are centered at the ground voltage. For a given single pixel, the differential voltage signal $V_{pixel}$ between its common and segment line may have four different amplitudes during different periods.

As shown in FIG. 2A, in an addressing period when the pixel is unselected (beyond its scan period) and a binary bit "H" is sent to the pixel, a square wave switching between 5.5V and 24.5V is applied to its common line and another square wave switching between 0V and 30V is applied to its segment line. The two square waves are in phase. Thus, the differential signal $V_{pixel}$ switches between −5.5V and 5.5V, and has an amplitude of 11V designed to be lower than $V_1$. The result is no change in the pixel.

As shown in FIG. 2B, in an addressing period when the pixel is unselected and a binary bit "L" is sent to the pixel, the square wave switching between 5.5V and 24.5V is applied to its common line and another square wave switching between 11V and 19V is applied to its segment line. The two square waves are in phase. Thus, the differential signal $V_{pixel}$ switches between 5.5V and −5.5V, and has an amplitude of 11V lower than $V_1$. The result is no change in the pixel. Those skilled in the art will appreciate that the unselected rows of the pixels (beyond the scan period) must be kept unchanged despite the data bits received.

As shown in FIG. 2C, in an addressing period when the pixel is selected (in its scan period) and the binary bit "H" is sent to the pixel, a square wave switching between 30V and 0V is applied to its common line and the square wave switching between 0V and 30V is applied to its segment line. The two square waves are out of phase (have a phase difference of 180°). Thus, the differential signal $V_{pixel}$ switches between −30V and 30V, and has an amplitude of 60V designed to be higher than $V_4$. As a result, the pixel is driven to the reflecting state as shown in FIG. 1.

As shown in FIG. 2D, in an addressing period when the pixel is selected and the binary bit "L" is sent to the pixel, the square wave switching between 30V and 0V is applied to its common line and the square wave switching between 11V and 19V is applied to its segment line. The two square waves are out of phase (have a phase difference of 180°). Thus, the differential signal $V_{pixel}$ switches between −19V and 19V, and has an amplitude of 38V designed to be located between $V_2$ and $V_3$. As a result, the pixel is driven to the transparent state as shown in FIG. 1.

Further, all pixels should be erased before addressing by the signals on the segment and common lines shown in FIGS. 2A–2D, by driving the pixels into reflecting state. Thus, in the erasing period, square waves having a phase difference of 180° with the square waves on the segment and common line as shown in FIG. 2C are applied to all pixels.

However, in the conventional single polar driving method, the common and segment drivers must be capable of providing tour different positive voltage levels. The design of the drivers with 4-level output is complicated and a relatively large number of power supplies must be used.

SUMMARY OF THE INVENTION

The object of the present invention is to provide a single polar driving method for FMLCD, which includes drivers with a smaller number of output levels to reduce both the number of power supplies needed and the circuit complexity.

The present invention provides a driving method for a display comprising a first substrate, a second substrate and a cholesteric liquid crystal sealed between the first and second substrate, wherein pixels are defined by common and segment lines respectively on the first and second substrate. The method comprises the steps of selecting one of the pixels by applying a first voltage signal switching between a ground and a first voltage level to the common line of the selected pixel, driving the selected pixel into a reflecting state by applying a second voltage signal out of phase with the first voltage signal and that switches between a second and third voltage levels to the segment line of the selected pixel, driving the selected pixel into a transparent state by applying a third voltage signal in phase with the first voltage signal and that switches between the second and third voltage levels to the segment line of the selected pixel, and unselecting one of the pixels by applying a fourth voltage signal fixed at a fourth voltage level to the common line of the unselected pixel, wherein the first, second, third and fourth voltage levels have the same polarity based on the ground voltage level, and magnitudes such that a waveform of a differential voltage signal between the segment and common line generated thereby in each pixel is centered at the ground voltage level.

The present invention further provides a driving method for a cholesteric liquid crystal display comprising pixels in an array of rows and columns, each pixel is driven by a differential signal between a segment and common signal thereof. The method comprises providing a clock signal with edges of a first and second type, receiving data bits to be sent to the pixels upon the edges of the first type of the clock signal, deriving an FR signal transformed from the clock signal, which has level transitions beyond the edges of the first type of the clock signal, and receiving the data bits and FR signal, and executing a first and second logic operation thereof to generate the segment and common signals respectively having a first and second level, and a third, fourth and ground level, wherein the common signals of the selected and unselected pixels respectively switch between the ground and third level, and are fixed at the fourth level, the segment signals of the selected pixels driven into a reflecting and transparent state both switch between the first and second level, and are respectively out of and in phase with the common signals thereof, the first, second, third and fourth levels have the same polarity based on the ground level, and magnitudes such that waveforms of the differential signals are centered at the ground level.

BRIEF DESCRIPTION OF THE DRAWINGS

The present invention will become more fully understood from the detailed description given hereinbelow and the accompanying drawings, given by way of illustration only and thus not intended to be limitative of the present invention.

FIGS. 6A and 6B respectively show the truth tables of the logic operations carried by the segment and common driver according to one embodiment of the invention.

DETAILED DESCRIPTION OF THE INVENTION

Figure 3:
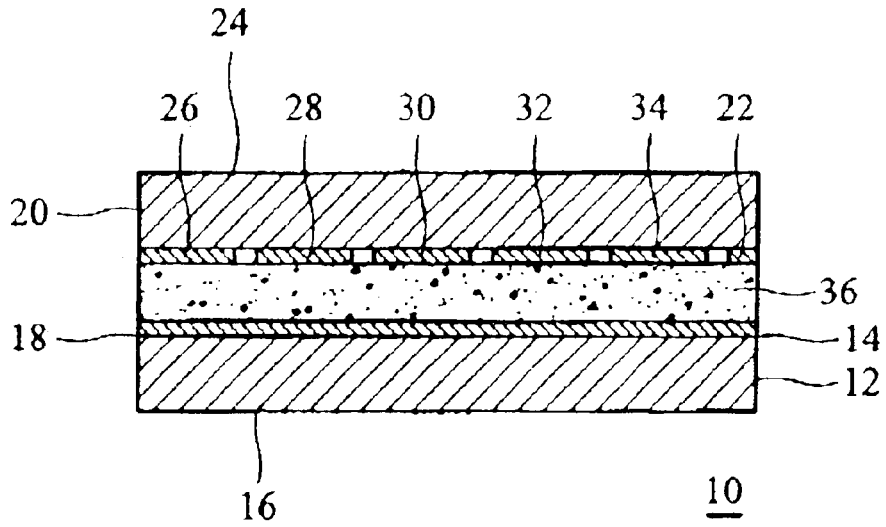
FIG. 3 is a partial side cross-section of a fast multistable display device using a cholesteric liquid crystal in accordance with the instant invention.

Referring now to FIG. 3, there is illustrated therein a partial side cross-section of a fast multistable display device using a cholesteric liquid crystal in accordance with the instant invention. The display 10 includes a first substrate 12 fabricated of an insulating material such as glass, plastic or some other polymeric material, examples of which include Donnelly Applied Films' ITO (indium tin oxide) coated sodalime glass substrates, Corning's silicate glass substrates, Southwall Technologies' ITO coated plastic substrates, and combinations thereof. The substrate 12 has first and second major surfaces 14 and 16. On the first major surface 14 of substrate 12 is disposed a layer of an electrically conductive material 18. The electrically conductive layer 18 should be a transparent material. Accordingly, the electrode layer 18 may be a thin layer of metal such as silver, copper, titanium, molybdenum, or combinations thereof, as long as the metals are very thin, and non-reflective. Alternatively, the layer 18 may be a thin layer of a transparent conductive material such as indium tin oxide. The layer may be fabricated as a plurality of elongated strips on the surface of the substrate 12.

Disposed opposite the first substrate 12 is a second substrate 20 fabricated of a high quality, transparent material such as glass or plastic. The substrate 20 has first and second major surfaces 22, and 24 respectively. Disposed on the first major surface 22 is a plurality of elongated strip electrodes 26, 28, 30, 32, 34, fabricated of a transparent conductive material, such as those described hereinabove with respect to layer 18.

The substrates 12 and 20 are arranged in opposed, facing relationship such that the layers of conductive material are parallel and facing one another. Disposed between the layers of conductive material is a layer of PSCT or PFCT liquid crystal material 36. The liquid crystal material has a periodic modulated optical structure that reflects light. The liquid crystal material comprises a nematic liquid crystal having positive dielectric anisotropy and chiral dopants. The material may further include a polymer gel or dye material. Thus, an electrical field may be applied to a layer of PSCT or PFCT liquid crystal material disposed therebetween. Once such as field is removed, the material is set to one of the two stable states, where it will remain until a new field is applied.

Figure 4:
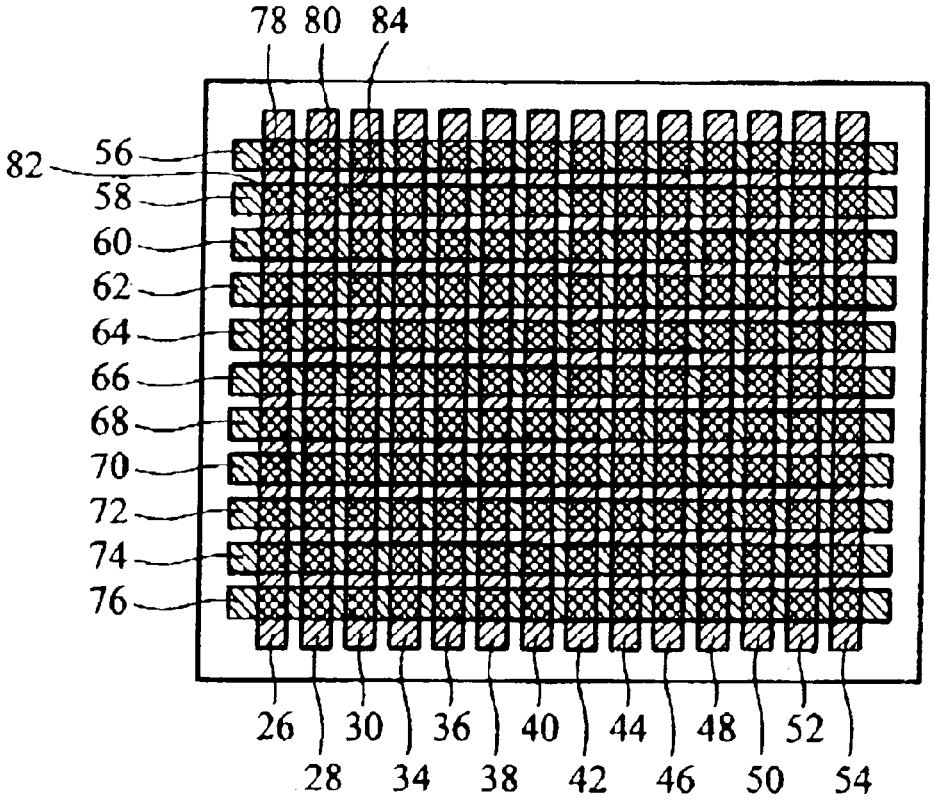
FIG. 4 is a front elevational view of the device illustrated in FIG. 3.

Referring now to FIG. 4, there is illustrated therein a front elevational view of the device illustrated in FIG. 3. The FMLCD segment (column) lines 26, 28, 30, 32, 34, 36, 38, 40, 42, 44, 46, 48, 50, 52, 54, and a plurality of orthogonally disposed common (row) lines 56, 58, 60, 62, 64, 66, 68, 70, 72, 74, and 76. At the intersection of each row and column, there is a crossover point, such as 78, 80, 82, or 84 defining the region of a pixel. It is to be understood that while only four crossover points have been identified, one exists at each intersection. Moreover, it is to be understood that while the FMLCD illustrated in FIG. 4 is a matrix of 11 rows by 14 columns, the FMLCD may be any number of rows and columns, arranged in any shape.

As noted above, the segment and common lines are fabricated of electrically conductive materials further coupled to electronic driving circuitry (not shown) for applying electronic driving or addressing voltages to the FMLCD. The circuitry is typically disposed around the peripheral edges of the display so as to not reduce the area of available display.

The single polar driving method of FMLCDs is described in the following accompanied by FIGS. 5A–5D. For a given single pixel, the differential voltage signal $V_{pixel}$ between its common and segment line may have four different amplitudes during different periods.

Figure 5A:
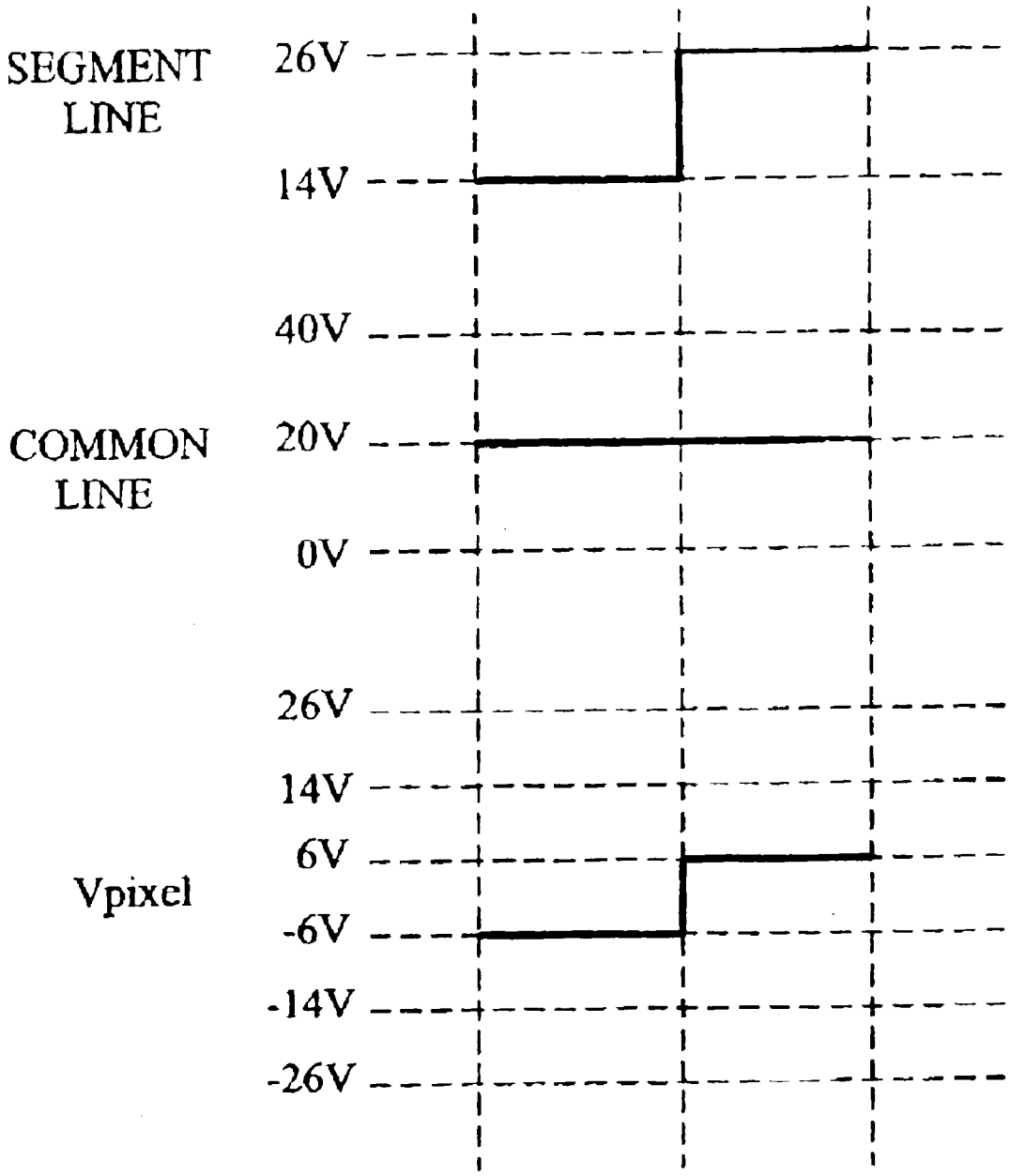
FIGS. 5A–5D are diagrams showing the signal waveforms used in a single polar driving method according to one embodiment of the invention.

As shown in FIG. 5A, in an addressing period when the pixel is unselected (beyond its scan period) and a binary bit "H" is sent to the pixel, a voltage signal fixed at 20V is applied to its common line and a square wave switching between 14V and 26V is applied to its segment line. Thus, the differential signal $V_{pixel}$ switches between −6V and 6V, and has an amplitude of 12V designed to be lower than $V_1$ shown in FIG. 1. The result is no change in the pixel.

Figure 5B:
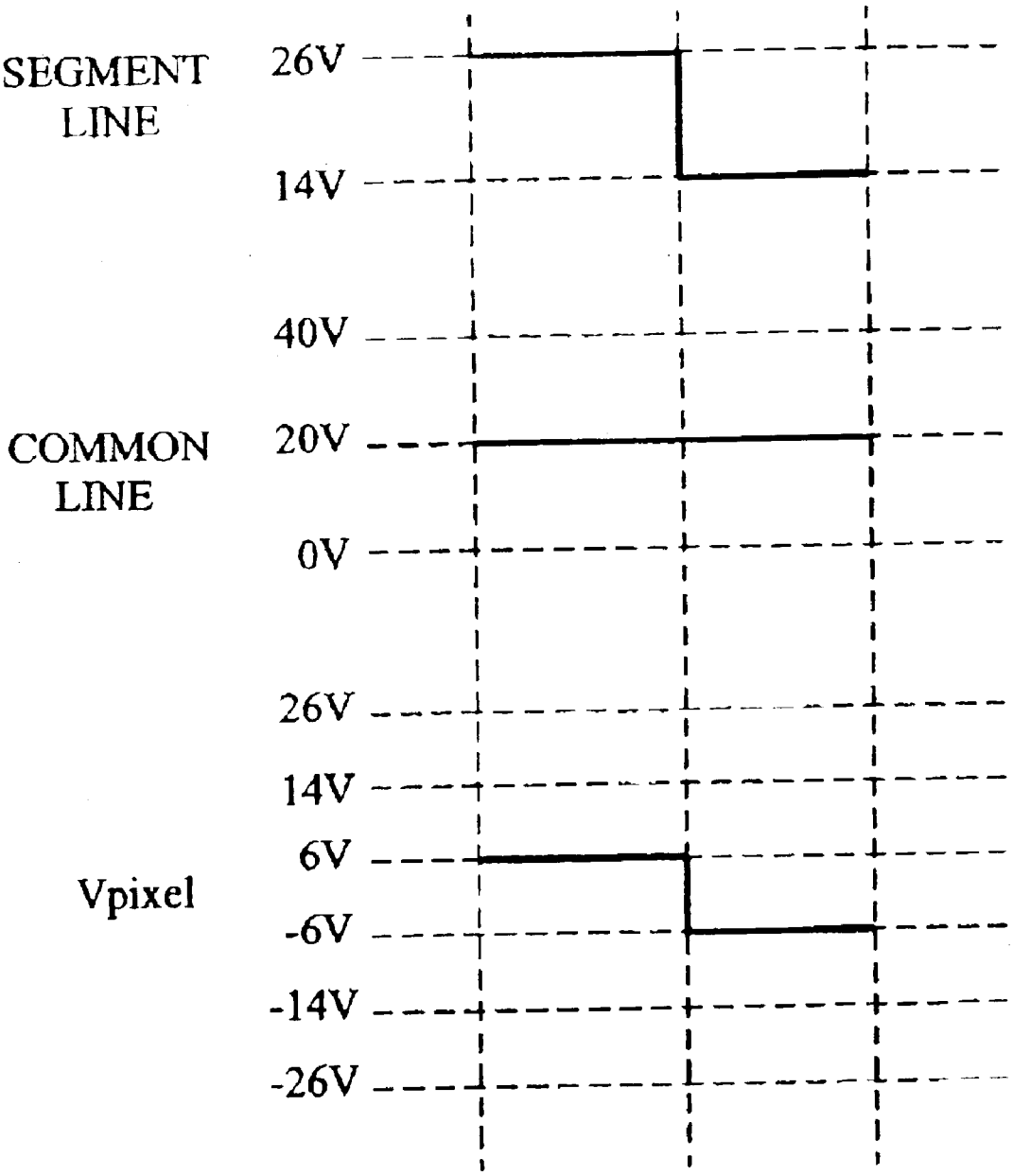

As shown in FIG. 5B, in an addressing period when the pixel is unselected and a binary bit "L" is sent to the pixel, the voltage signal fixed at 20V is applied to its common line and another square wave switching between 26V and 14V is applied to its segment line. It is noted that the square wave representing the bit "L" here has a same amplitude but is out of phase (has a phase difference of 180°) with that representing the bit "H" in FIG. 5A. Thus, the differential signal $V_{pixel}$ switches between 6V and −6V and has an amplitude of 12V lower than $V_1$. The result is no change in the pixel.

Figure 1:
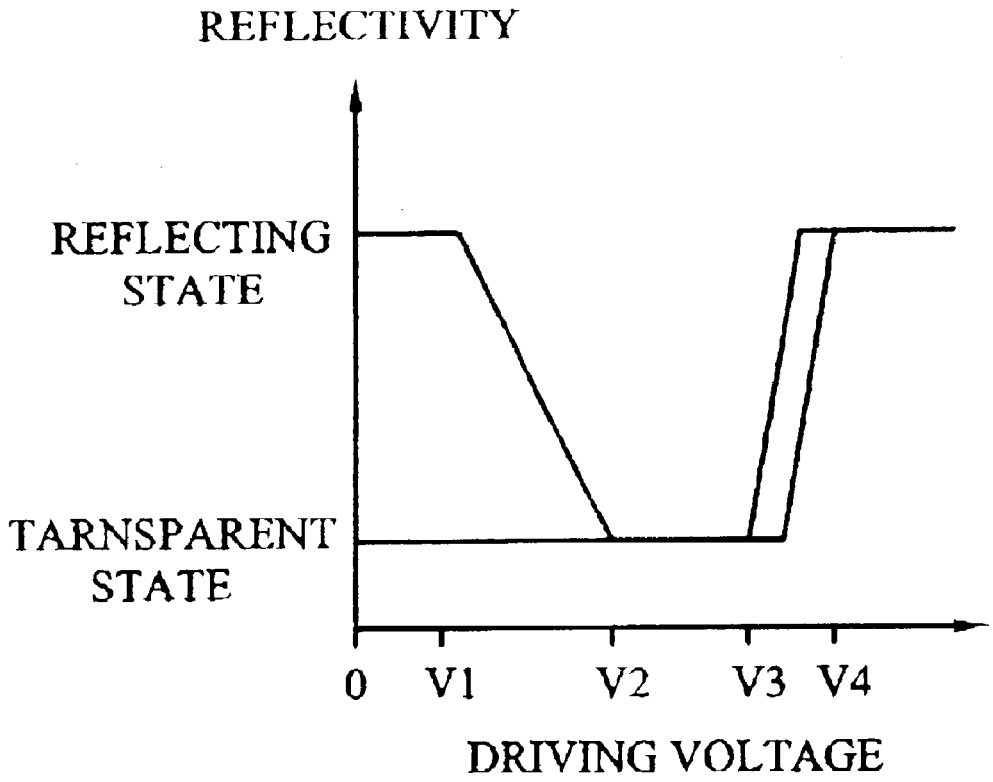
FIG. 1 illustrates a table showing the state of the liquid crystal material after the application of various driving voltages thereto.
Figure 2A:
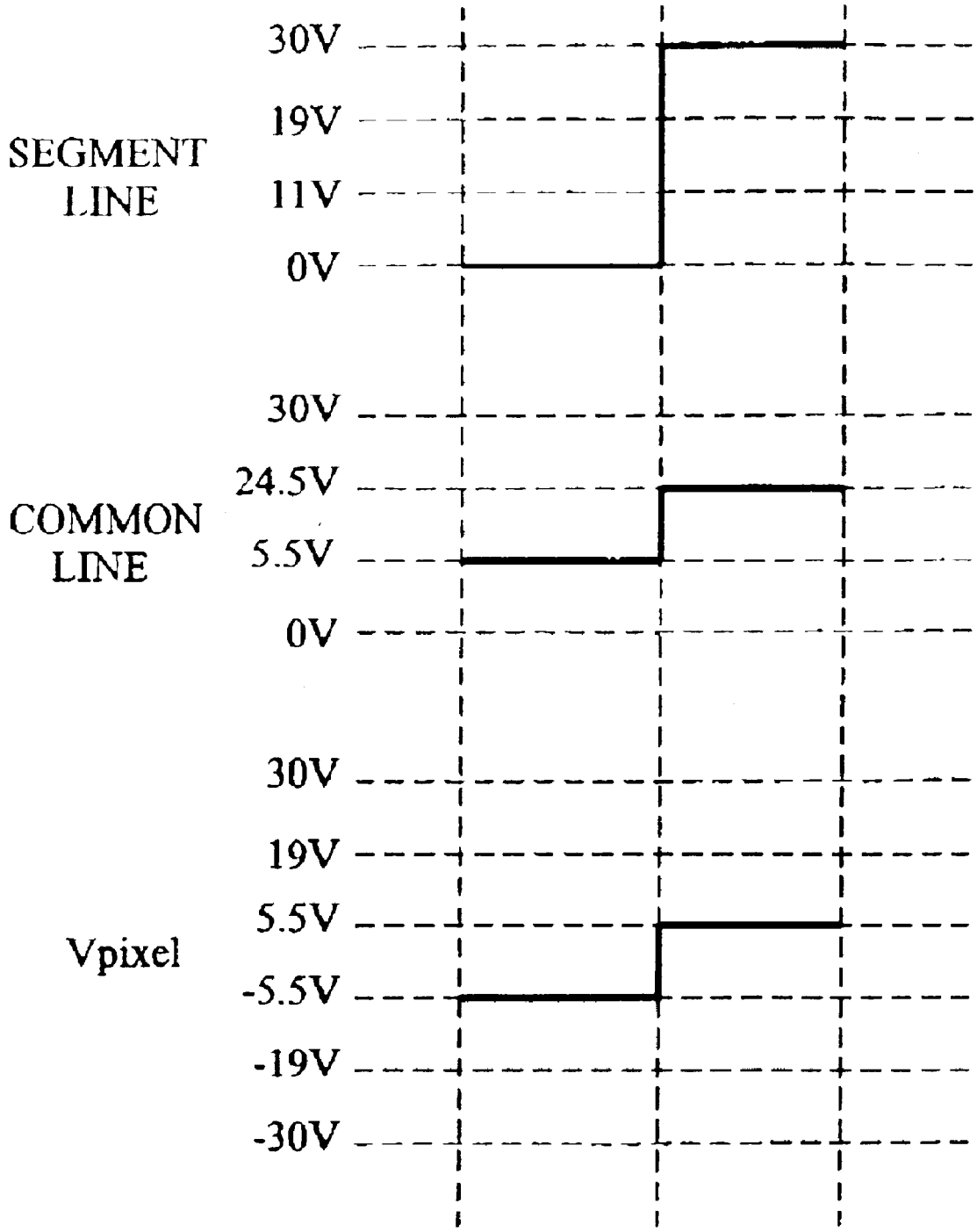
FIG. 2A ( PRIOR ART )
FIGS. 2A–2D are diagrams showing the signal waveforms used in a conventional single polar driving method.
Figure 2B:
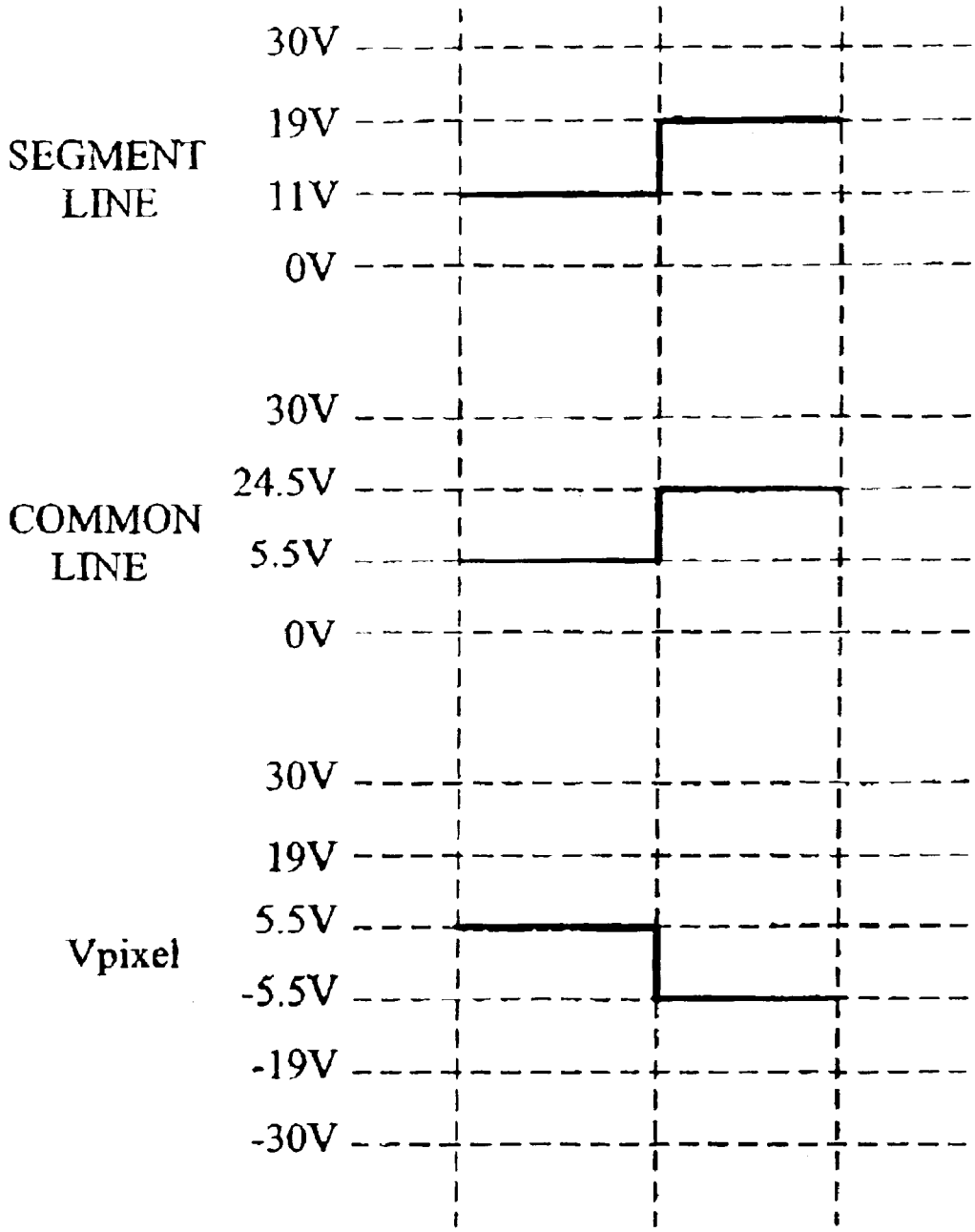
FIG. 2B ( PRIOR ART )
Figure 2C:
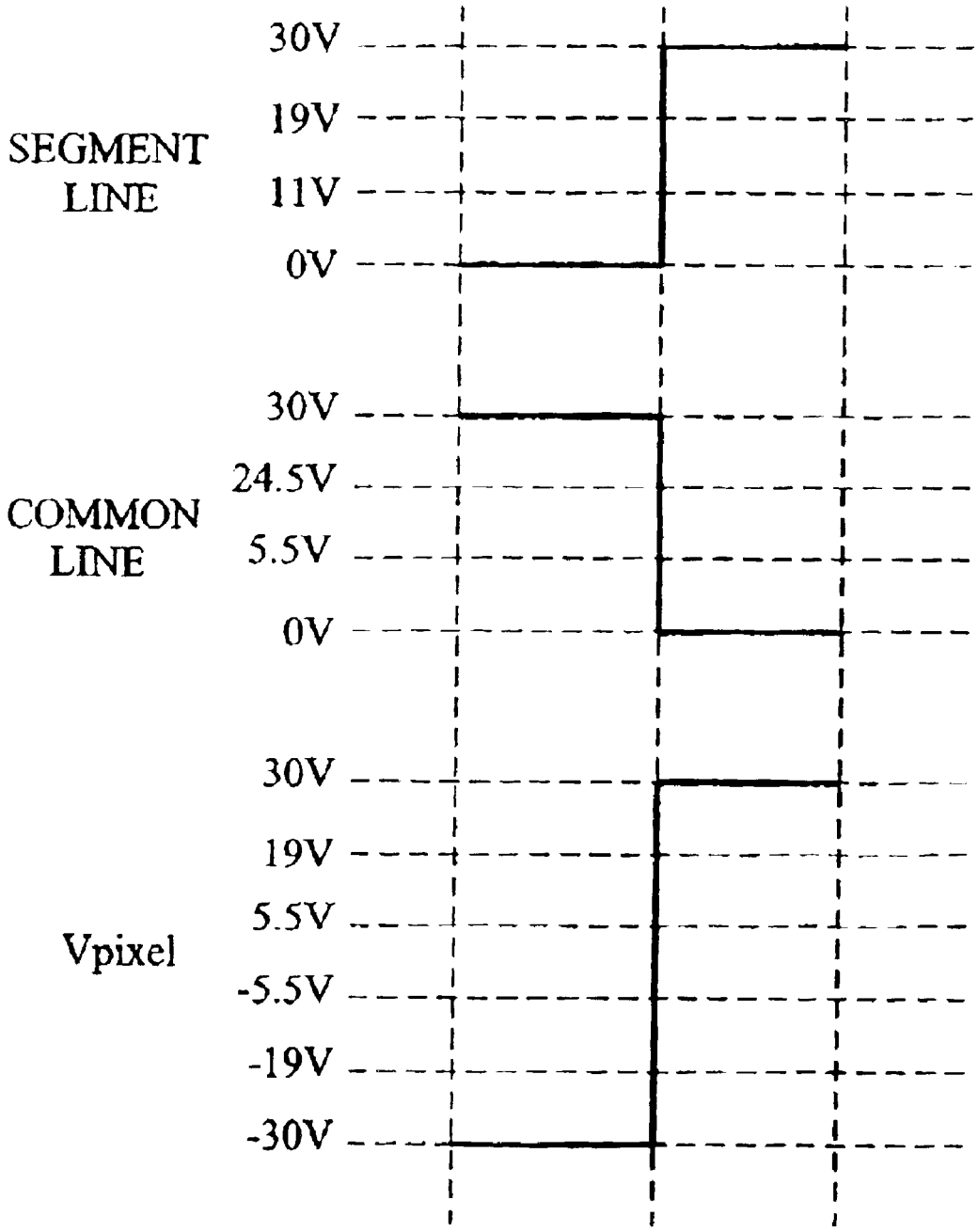
FIG. 2C ( PRIOR ART )
Figure 2D:
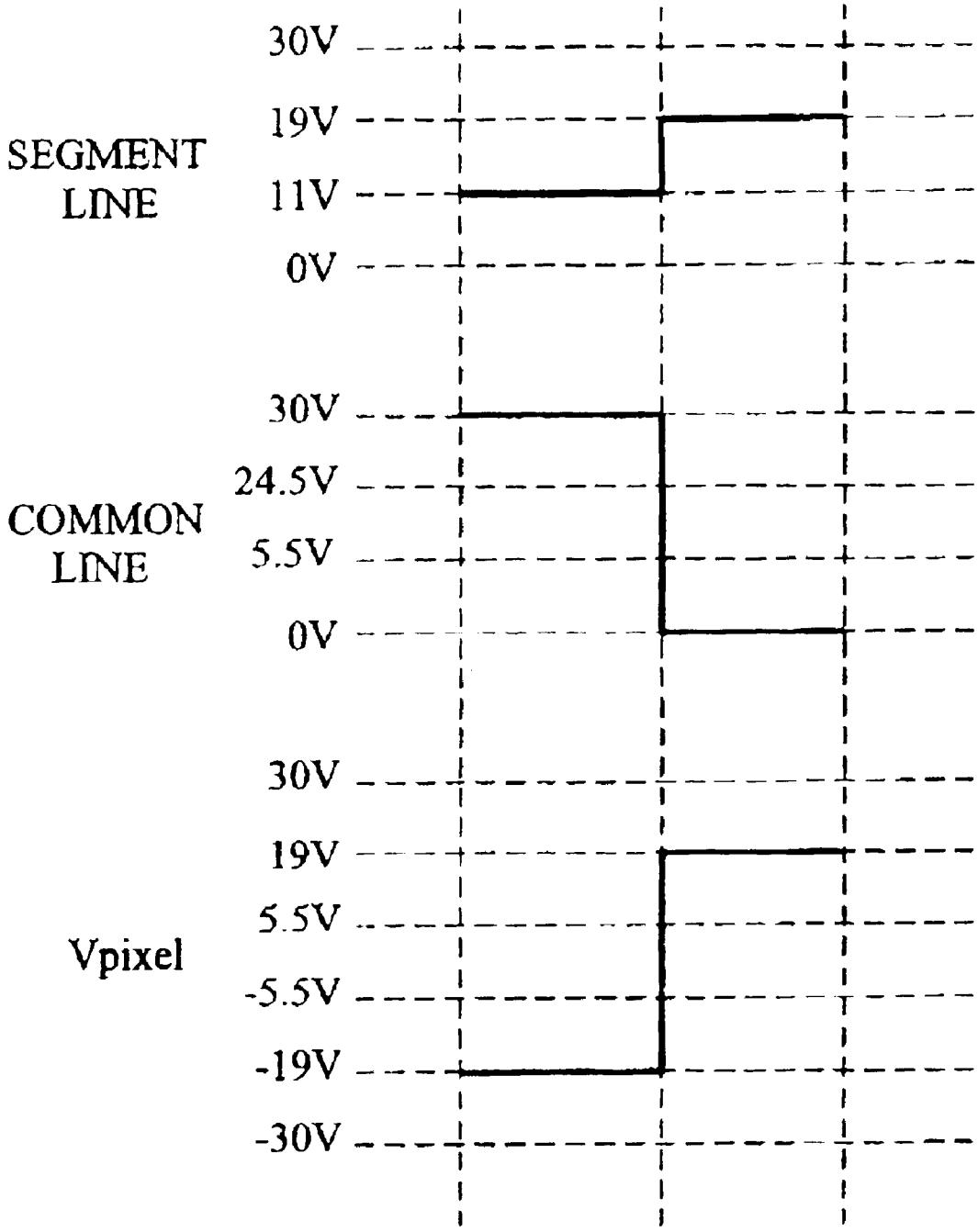
FIG. 2D ( PRIOR ART )
Figure 5C:
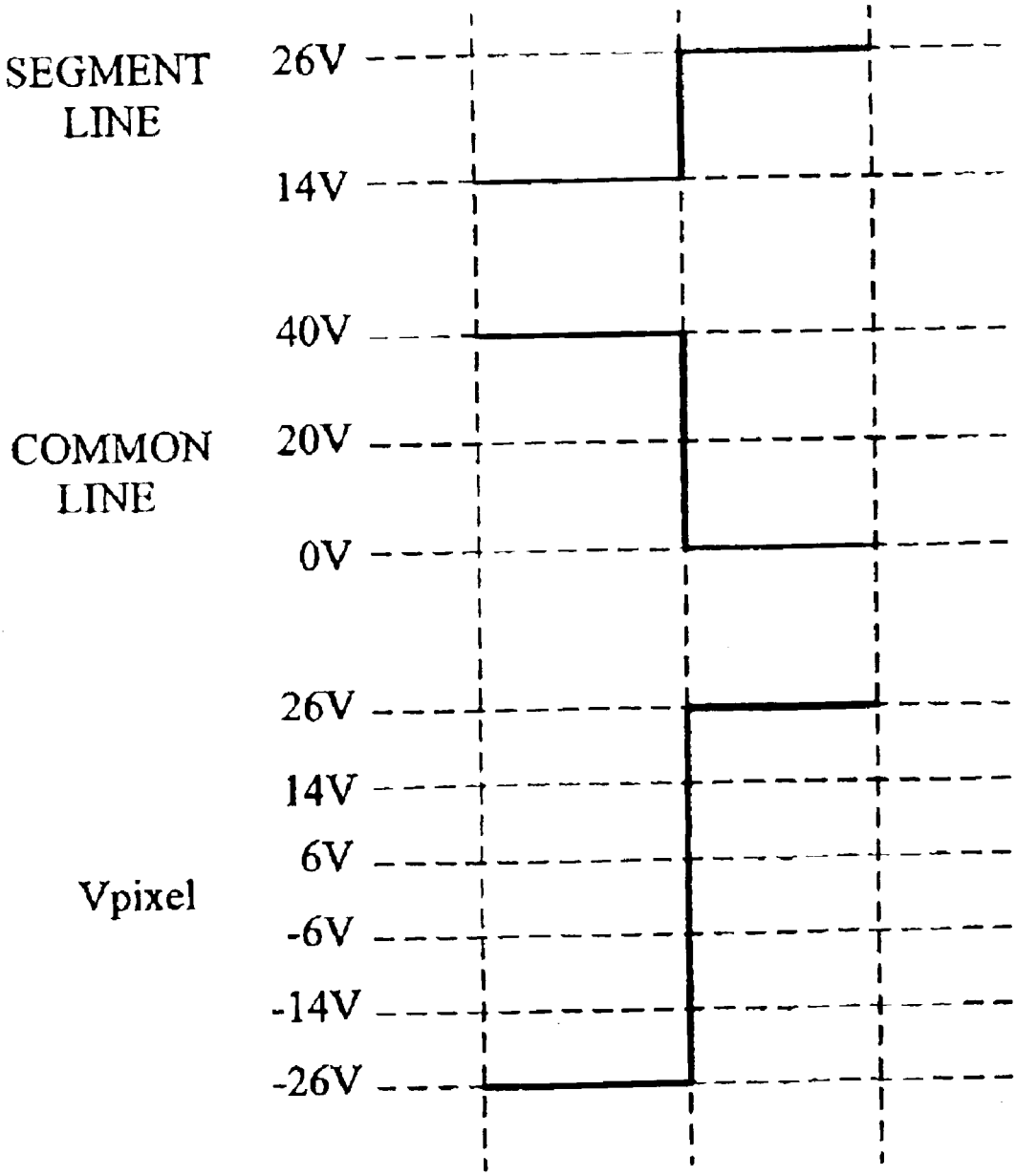

As shown in FIG. 5C, in an addressing period when the pixel is selected (in its scan period) and the binary bit "H" is sent to the pixel, a square wave switching between 40V and 0V is applied to its common line and the square wave switching between 14V and 26V is applied to its segment line. The two square waves are out of phase (have a phase difference of 180°). Thus, the differential signal $V_{pixel}$ switches between −26V and 26V and has an amplitude of 52V designed to be higher than $V_4$ shown in FIG. 1. As a result, the pixel is driven to the reflecting state as shown in FIG. 1.

Figure 5D:
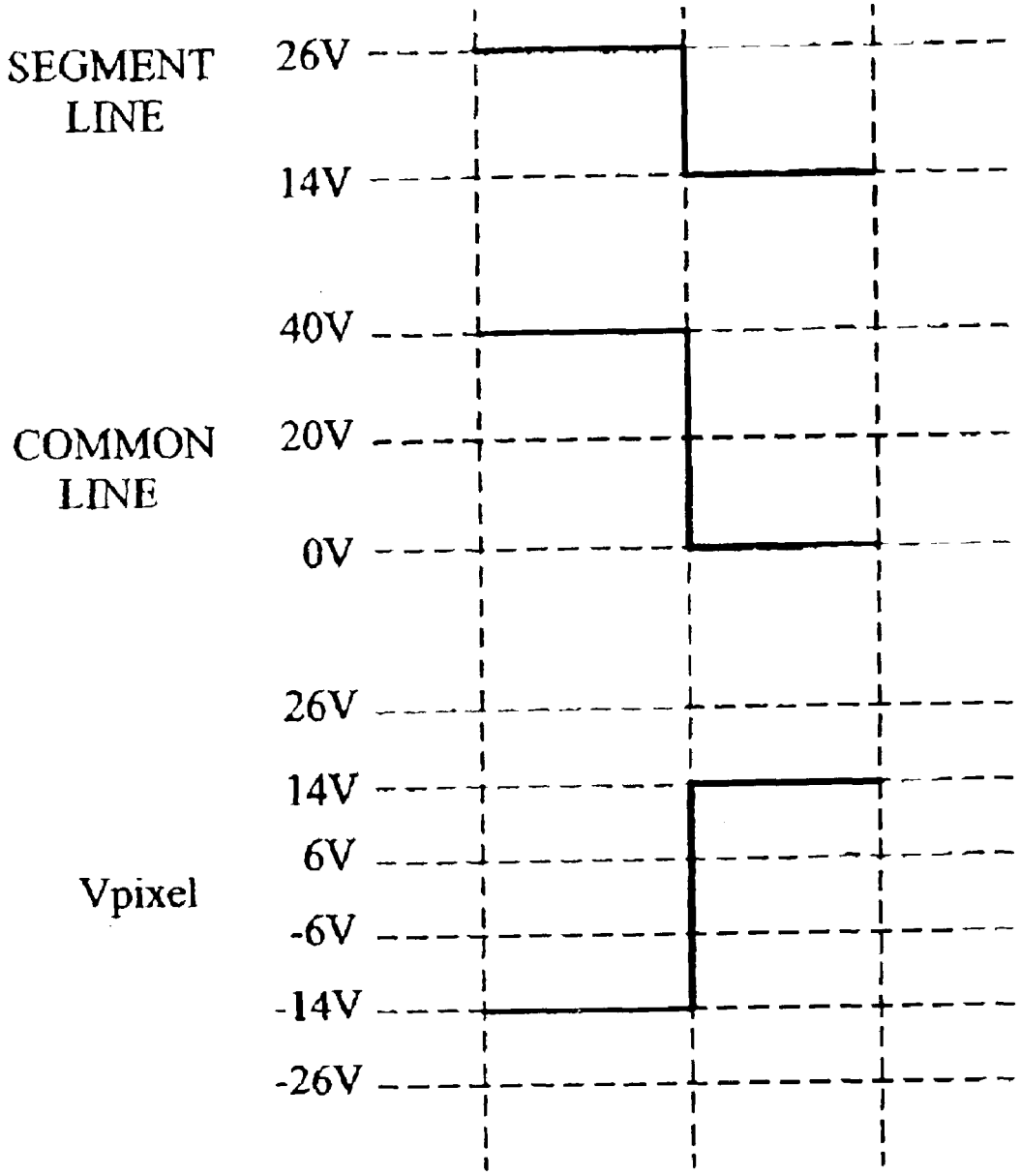

As shown in FIG. 5D, in an addressing period when the pixel is selected and the binary bit "L" is sent to the pixel, the square wave switching between 40V and 0V is applied to its common line and the square wave switching between 26V and 14V is applied to its segment line. The two square waves are in phase. Thus, the differential signal $V_{pixel}$ switches between −14V and 14V, and has an amplitude of 28V designed to be located between $V_2$ and $V_3$ shown in FIG. 1. As a result, the pixel is driven to the transparent state as shown in FIG. 1.

In the erasing period, square waves having a phase difference of 180° from the square waves on the segment and common line as shown in FIG. 5C are applied to all pixels.

In the previously described single polar driving method, it is noted that the common driver has three output levels $V_{CL}$ (0V), $V_{CM}$ (20V) and $V_{CH}$ (40V), and the segment driver has two output levels $V_{SL}$ (14V) and $V_{SH}$ (26V). Further, the output levels of the common and segment driver are derived respectively by carrying logic operations of the pixel data bits to be sent and a signal FR transformed from the system clock signal. FIGS. 6A and 6B respectively show the truth tables of the logic operations carried by the segment and common driver.

Figure 7A:
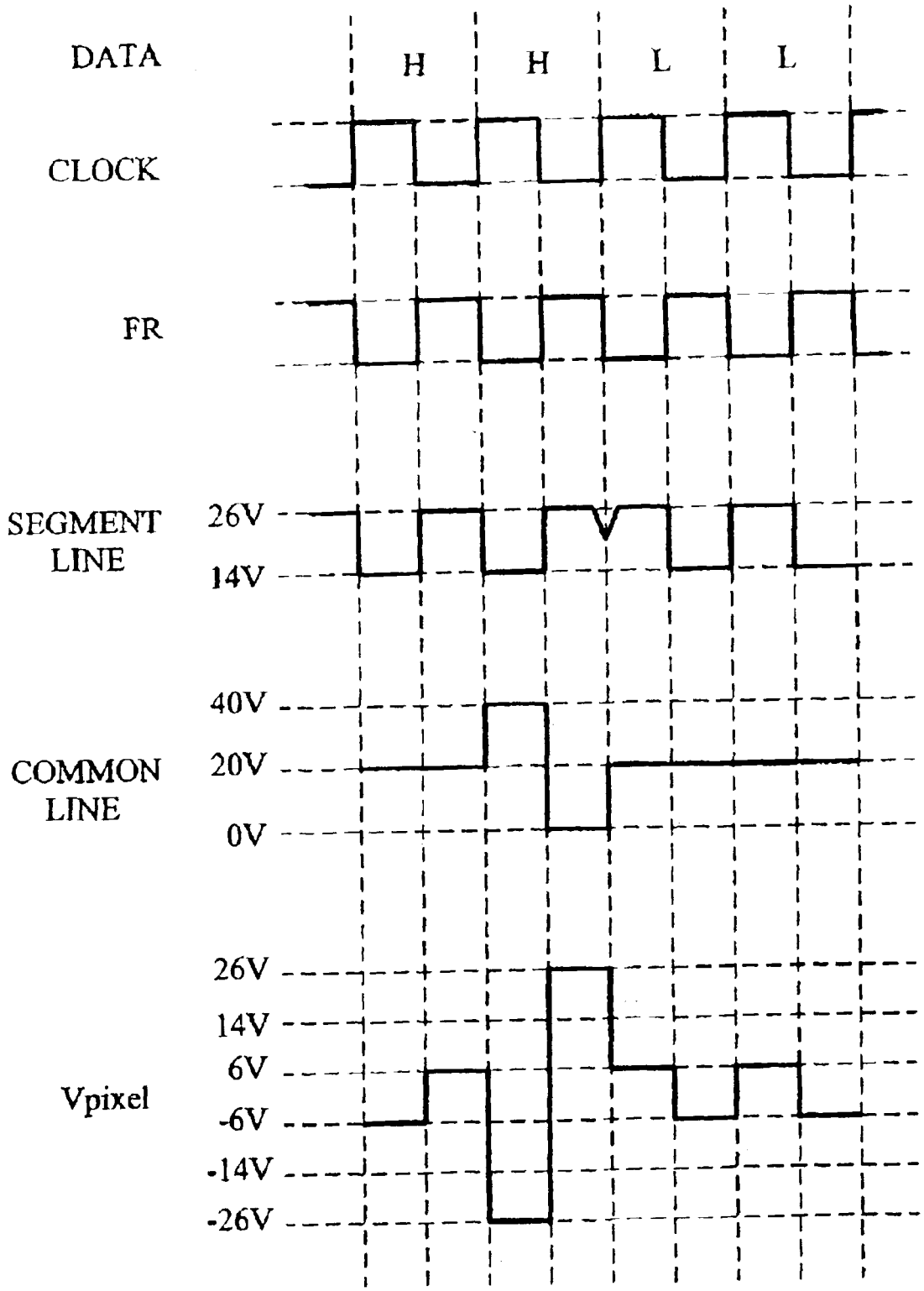
FIG. 7A is a diagram showing waveforms of the signals according to the truth table shown in FIG. 6A when the pixel data bits to be sent are "H", "H", "L" and "L".

FIG. 7A is a diagram showing waveforms of the signal FR, clock signal, voltage signals $V_{SEG}$ and $V_{COM}$ applied by the segment and common driver to a segment and common line respectively, and resulting signal $V_{pixel}$ according to the truth table shown in FIG. 6A when the pixel data bits to be sent are "H", "H", "L" and "L" for example. The pixel data bits switch upon the rising edges of the clock signal. Theoretically, the waveform of the signal $V_{SEG}$ is perfectly square. However, in fact, there is a sudden drop in the signal $V_{SEG}$ when the pixel data bit switch from "H" to "L". This is because each of the level transitions from high to low of the signal FR occurs upon each of the rising edges of the clock signal. The sudden transitions of the signal FR interfere with the signal $V_{SEG}$.

Figure 7B:
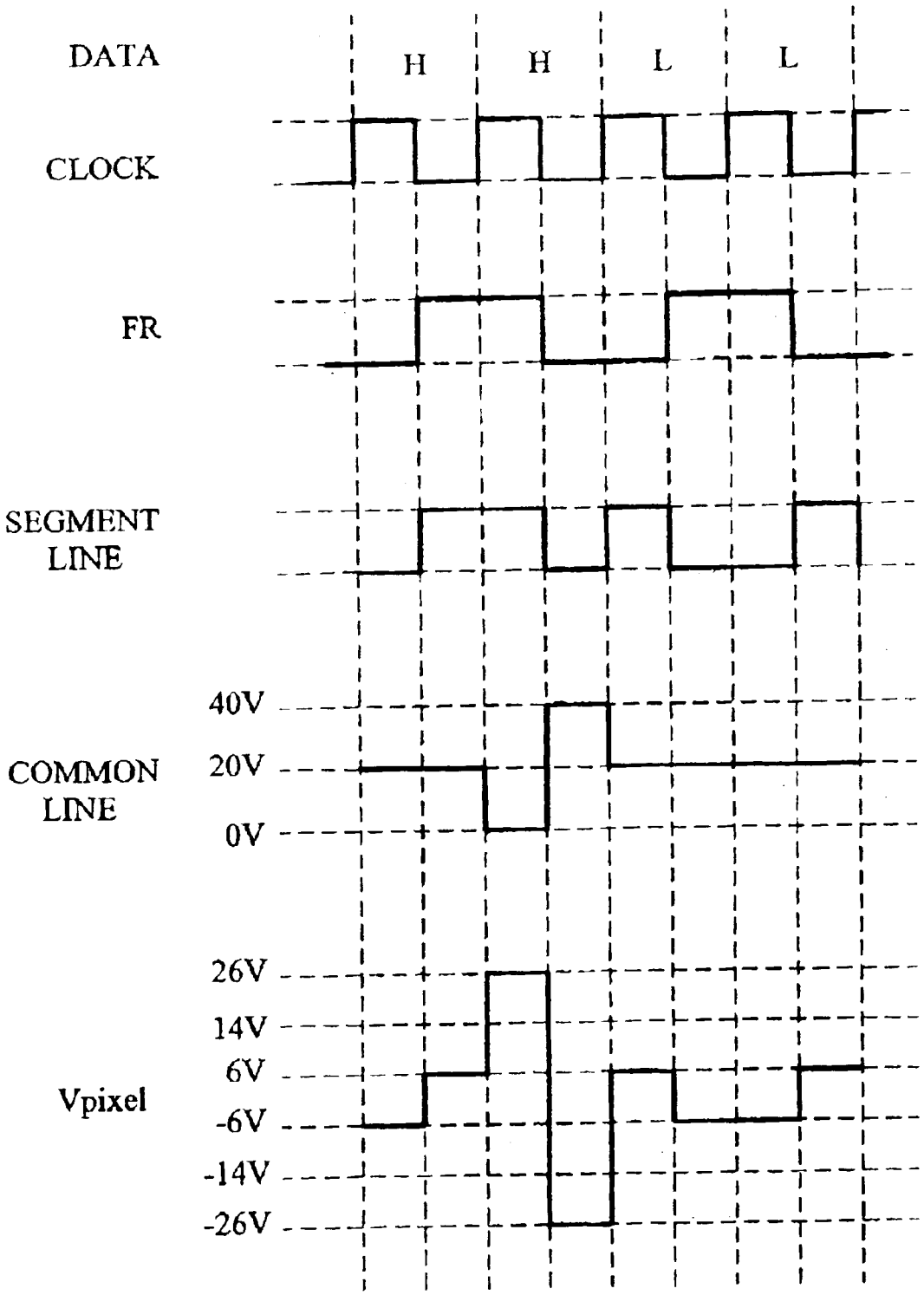
FIG. 7B is a diagram showing waveforms of the signals according to the truth table shown in FIG. 6A when the pixel data bits to be sent are "H", "H", "L" and "L" and the signal FR is modified.

The interference may be avoided by modifying the waveform of the signal FR, as shown in FIG. 7B. The frequency of the modified signal FR' is halved by inverting the waveform of the original signal FR in alternate periods starting from the rising edges of the clock signal. This results in the waveforms of signals $V_{SEG}$ and $V_{COM}$ and resulting signal $V_{pixel}$ are also changed as the waveform of the signal FR is. Thus, the level transitions of the modified signal FR' only occur upon the falling edges of the clock signal, which has no significantly disadvantageous effect on the signal $V_{SEG}$.

In conclusion, the present invention provides a single polar driving method for FMLCD, wherein the numbers of the output levels of the drivers are reduced by differentiating "H" and "L" from a difference of phase rather than amplitude in the segment signal and by giving a fixed level to the common signal beyond the scan period. Thus, the number of power supplies needed and circuit complexity are also reduced.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

What is claimed is:

1. A driving method for a display comprising a first substrate, a second substrate and a cholesteric liquid crystal sealed between the first and second substrate, wherein pixels are defined by common and segment lines respectively on the first and second substrate, the method comprising the steps of:

selecting one of the pixels by applying a first signal switching between a ground and a first voltage level to the common line of the selected pixel;

driving the selected pixel into a reflecting state by applying a second signal out of phase with the first signal and that switches between a second and third voltage levels to the segment line of the selected pixel;

driving the selected pixel into a transparent state by applying a third signal in phase with the first signal and that switches between the second and third voltage levels to the segment line of the selected pixel; and deselecting one of the pixels by applying a fourth signal fixed at a fourth voltage level to the common line of the unselected pixel;

wherein the first, second, third and fourth voltage levels have the same polarity based on the ground voltage level, and magnitudes such that a waveform of a differential voltage signal between the segment and common line generated thereby in each pixel is centered at the ground voltage level.

2. The method as claimed in claim 1, wherein the ground, first, second, third and fourth voltage levels are respectively 0V, 40V, 14V, 26V and 20V.

3. The method as claimed in claim 1, wherein the first and second signals have a phase difference of 180°.

4. The method as claimed in claim 1 further comprising erasing the pixels by driving the pixels into the reflecting state.

5. The method as claimed in claim 1 further comprising erasing the pixels by applying the inverted second signal and inverted first signal to the segment and common lines of the pixels respectively.

6. A driving method for a cholesteric liquid crystal display comprising pixels in an array of rows and columns, each pixel driven by a differential signal between a segment and common signal thereof, the method comprising the steps of:

providing a clock signal with edges of a first and second type;

receiving data bits to be sent to the pixels upon the edges of the first type of the clock signal;

deriving an FR signal transformed from the clock signal, which has level transitions beyond the edges of the first type of the clock signal; and receiving the data bits and FR signal, and carrying a first and second logic operation thereof to is generate the segment and common signals respectively having a first and second level, and a third, fourth and ground level;

wherein the common signals of the selected and unselected pixels respectively switch between the ground and third level, and are fixed at the fourth level, the segment signals of the selected pixels driven into a reflecting and transparent state both switch between the first and second level, and are respectively out of and in phase with the common signals thereof, the first, second, third and fourth levels have the same polarity based on the ground level, and magnitudes such that waveforms of the differential signals are centered at the ground level.

7. The method as claimed in claim 6, wherein the ground, first, second, third and fourth levels are respectively 0V, 40V, 14V, 26V and 20V.

8. The method as claimed in claim 6, wherein the segment signals of the selected pixels driven into the reflecting have a phase difference of 180° from the common signals thereof.

9. The method as claimed in claim 6, wherein the pixels are erased by being driven into the reflecting state.

10. The method as claimed in claim 6, wherein the common and segment signals of the pixels to be erased respectively switch between the ground and third level, and the first and second level.

11. The method as claimed in claim 6, wherein the edges of the first and second type of the clock signal are respectively rising and falling edges.

* * * * *